US006177021B1

(12) United States Patent
Matusch et al.

(10) Patent No.: US 6,177,021 B1
(45) Date of Patent: Jan. 23, 2001

(54) METHOD AND DEVICE FOR CLEARING THE CRYSTALLINE MATERIAL OUT OF A CENTRIFUGE BASKET

(75) Inventors: Siegfried Matusch, Braunschweig; Mario Winnemuth, Hannover, both of (DE)

(73) Assignee: Braunschweigische Maschinenbauanstalt AG, Braunschweig (DE)

( * ) Notice: Under 35 U.S.C. 154(b), the term of this patent shall be extended for 0 days.

(21) Appl. No.: 09/301,624

(22) Filed: Apr. 29, 1999

(30) Foreign Application Priority Data

Apr. 29, 1998 (DE) ..... 198 19 065

(51) Int. Cl.[7] ..... B01P 33/06

(52) U.S. Cl. ..... 210/781; 210/791; 210/360.1; 210/372; 210/375; 210/380.1; 210/391; 210/394; 210/396; 210/402; 494/36; 494/37; 494/58

(58) Field of Search ..... 210/781, 791, 210/360.1, 369, 372, 375, 380.1, 391, 394, 396, 402, 408; 494/36, 58, 37

(56) References Cited

U.S. PATENT DOCUMENTS 5,252,202 10/1993 Hirose ..... 210/86
5,338,459 8/1994 Hirose ..... 210/710
5,460,717 * 10/1995 Grimwood et al. ..... 210/369
5,595,655 * 1/1997 Steiner et al. ..... 210/396
5,891,347 * 4/1999 Matsumoto ..... 210/369

FOREIGN PATENT DOCUMENTS 1 043 224 8/1956 (DE) .
42 11 254 5/1993 (DE) .
0 785 030 A2 7/1997 (EP) .
WO 97/15400 5/1997 (WO) .

* cited by examiner

*Primary Examiner*—David A. Reifsnyder
(74) *Attorney, Agent, or Firm*—Foley & Lardner

(57) ABSTRACT

The invention relates to a method and a device for clearing product, e.g., sugar, from the inside of a centrifuge basket of a discontinues centrifuge. A scraper blade, which is attached to a clearing rod, is pivoted toward the spun-off layer of product. The scraper blade scrapes off the product with a cutting edge, which is directed in a direction that is opposite to the direction of rotation of the basket. To optimize the product removal, it is preferable if the scraper blade, after it has been pivoted inward, contacts the product over virtually the entire height of the basket and at the same time scrapes off the product from the layer of product which is rotating at the clearing rotational speed in layers over the entire height of the basket. Once the product has been substantially completely removed from the basket, the scraper blade is pivoted back away from the basket wall.

13 Claims, 2 Drawing Sheets

METHOD AND DEVICE FOR CLEARING THE CRYSTALLINE MATERIAL OUT OF A CENTRIFUGE BASKET

BACKGROUND OF THE INVENTION

1. Field of the Invention

The invention relates to a method and device for clearing the product from of a centrifuge basket of a discontinues centrifuge in which a scraper blade is pivoted toward the spun-off layer of product and, in this area, scrapes the product from the basket with a cutting edge, which is directed in a direction opposite to the rotation direction of the basket.

2. Description of Related Art

In a known embodiment, the clearing device includes a plow share that is pivotable about a vertical clearing rod. A scraper blade is resiliently and rotatable mounted to the plow share. The scraper blade, which extends over only a short section of the overall height of the centrifuge basket, is pressed into the layer of product (e.g., a layer of sugar) in a direction that is opposite to the rotation direction of the centrifuge basket until it comes to bear against the working sieve. The scraper blade is then moved axially downward out of its top position toward the basket base, and is then moved axially back upward, before returning to its initial position.

SUMMARY OF THE INVENTION

It is a general object of the invention to provide an improved device for removing product from the inside of a centrifuge basket.

A further object of the invention is to provide an improved process for removing product from the inside of a centrifuge basket.

It is a specific object of the invention to optimize product removal efficiency.

It is another object of the invention to reduce the time required to remove the product from the inner wall of the centrifuge basket.

It is still another object of the invention to reduce the amount of residual product that remains in the centrifuge basket upon completing the removal process.

A preferred embodiment of the inventive process which is intended to accomplish at least some of the foregoing objects includes first pivoting the scraper blade toward an inner wall of the basket, wherein the scraper blade lies in a direction opposite to a rotation direction of the basket, and wherein the scraper blade contacts the product over approximately the entire height of the wall of the basket; scraping the product from the basket wall; ceasing the pivoting of the scraper blade when the cutting edge reaches a desired position prior to touching the inner wall of the basket; and pivoting the scraper blade away from the basket wall.

A preferred embodiment of the inventive device which is intended to accomplish at least some of the foregoing objects includes a clearing rod having an axis at least generally parallel to the rotational axis of the basket; and a scraper blade, having a cutting edge, pivotally mounted on the clearing rod for pivoting about the axis of the clearing rod, wherein the cutting edge, after the scraper blade is pivoted in a direction toward the inner wall of the centrifuge basket, extends over approximately the entire height of the centrifuge basket.

Additional objects, features, and advantages of the invention will become apparent from the following description of preferred embodiments of the invention.

BRIEF DESCRIPTION OF THE DRAWINGS

The accompanying drawings, which are incorporated in and constitute part of the specification, illustrate presently preferred embodiments of the invention, and, together with the above general description and the following detailed description, serve to explain the principles of the invention.

DETAILED DESCRIPTION OF THE PREFERRED EMBODIMENTS

Figure 1:
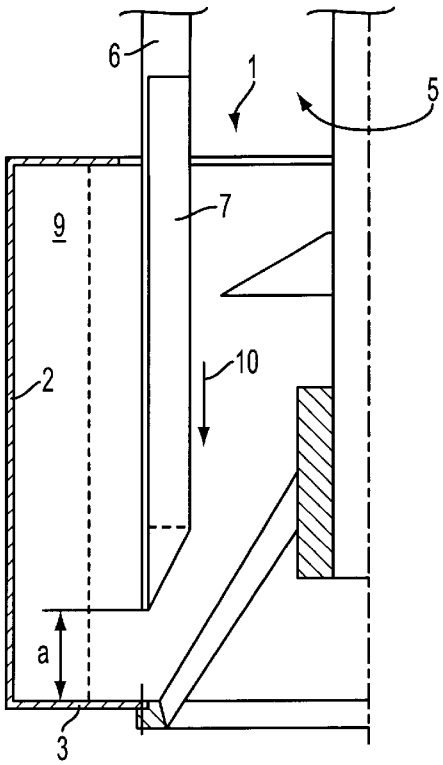
FIG. 1 is a vertical section through the center of the left half of the centrifuge basket of a discontinues centrifuge having a clearing-out device projecting into the centrifuge vertically from above and is in the raised position with the scraper blade pivoted away from the wall.

The preferred embodiments of the method according to the invention preferably include pivoting a scraper blade toward the wall of the centrifuge basket such that the scraper blade contacts the product which lines the inside of the centrifuge basket. The scraper blade preferably will be in contact with the product over virtually the entire height of the basket. While the scraper blade contacts the product, it is preferably scraping the product off in layers as the centrifuge rotates at its clearing speed. When the product has been substantially completely removed from the centrifuge basket and the scraper blade reaches the basket sieve, the scraper blade is pivoted away from the wall. As a result, after the scraper blade has been pivoted toward the wall, the scraping begins simultaneously over the entire height of the drum, thus reducing the removal time and making the removal of product more even.

A preferred embodiment of the method of the invention intended to accomplish at least some of the foregoing objects includes lowering a scraper blade having a cutting edge from an initial position until the scraper blade nearly touches a base of the centrifuge basket; pivoting the scraper blade toward an inner wall of the basket, wherein the scraper blade lies in a direction opposite to a rotation direction of the basket, and wherein the scraper blade contacts the product over approximately the entire height of the wall of the basket; scraping the product from the basket in a plurality of layers; ceasing the pivoting of the scraper blade toward the wall when the cutting edge approximately touches the inner wall of the basket; pivoting the scraper blade outward; and raising the scraper blade away from the base of the centrifuge basket into the initial position.

A preferred embodiment of the product clearing device according to the invention and for practicing the above method includes a vertically displaceable clearing rod having an axis; and a scraper blade, having a cutting edge, mounted to the clearing rod, wherein the scraper blade pivots about the axis of the clearing rod, and wherein the cutting edge, after the scraper blade is pivoted in a direction toward the wall, extends over approximately an entire height of the centrifuge basket.

To prevent the centrifuge from hitting the clearing device when the centrifuge is shaking, it is preferable if the scraper blade, before being pivoted toward the wall, is axially lowered slightly into the centrifuge basket to the basket base. After the scraper blade is pivoted away from the wall, it is raised again from the basket base by a corresponding axial distance. This axial distance, for example, may be about 200 mm, so that the scraper blade, in its at-rest or initial position, is at a sufficient distance from the internal mechanisms of the centrifuge and from the basket edge. To reduce the clearing time, it is preferable if the scraper blade is lowered into the centrifuge basket while the basket is decelerating from its spin-off speed to its clearing speed.

According to the invention, the efficiency of the product removal is increased if the scraper blade is pivoted toward the wall in the direction of rotation of the centrifuge basket and is pivoted away from the wall in the opposite direction to this direction of rotation. Pivoting the blade away from the wall in the opposite direction to the direction of rotation of the basket adds the residual product on the bottom edge of the scraper blade to the product removed.

To reduce the wear on the working sieve and on the scraper blade, it is preferable if the pivoting of the scraper blade toward the wall is terminated just before the scraper blade comes into metal-to-metal contact with the basket sieve. After the cutting edge of the scraper blade reaches the inner wall or basket sieve of the centrifuge basket, to increase the efficiency of product removal, it is desirable to hold the scraper blade in place for a dwell time, which is preferably only a few seconds, e.g., 2–5 seconds.

In order to transport the product away without problems during the scraping operation, the scraper blade (in horizontal section) is preferably slightly concave on its front side. Moreover, to reduce wearing of the cutting edge of the scraper blade and to achieve gentle cleaning of the sieve, it is advantageous if the cutting edge of the scraper blade forms an angle between 80° to slightly less than 90° with respect to the basket sieve or the basket shell.

The scraper blade preferably may be controlled pneumatically by means of electropneumatic valves. It is also preferable, to prevent product from accumulating on the scraper blade and to optimize the product flow, to provide the scraper blade with a nonstick coating.

It is also preferable, particularly with respect to sugar centrifuges, to provide a tubular clearing rod having a nozzle stem, or individual nozzles, for adding wash-water to the sugar. This makes it possible to eliminate an entire subassembly from the product chamber of a sugar centrifuge.

Referring now to the drawings, wherein like numerals indicate like parts, and initially to FIG. 1, there will be seen a centrifuge basket 1 having a basket shell 2, which is provided with holes and is covered on its inner wall by a working sieve (not shown in more detail). The base 3 of the basket has a central product discharge opening, which can be closed off by a closure cap (not shown in more detail). The direction of rotation of the centrifuge basket 1 is indicated by an arrow 5.

There is also a clearing-out device, which is arranged in a stationary, eccentric position, or initial position, and of which only an axially parallel clearing rod 6 and a scraper blade 7, which is attached to this clearing rod 6, are shown. The clearing-out device projects into the centrifuge basket 1 vertically from above. By rotating the clearing rod 6 in the direction of the arrow 8 shown in FIGS. 3 and 4, the scraper blade 7 is pivoted toward the basket shell 2.

Figure 3:
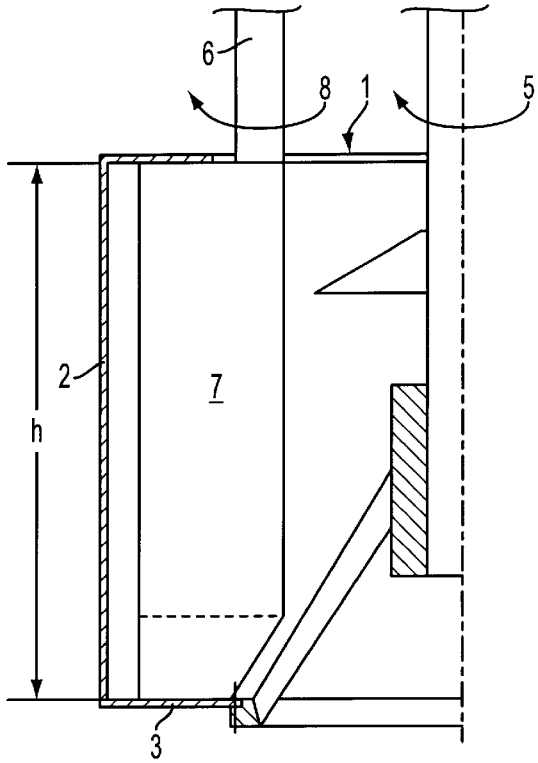
FIG. 3 is the same illustration as that of FIG. 1, but with the clearing-out device in the lowered position and with the scraper blade pivoted toward the wall.
Figure 4:
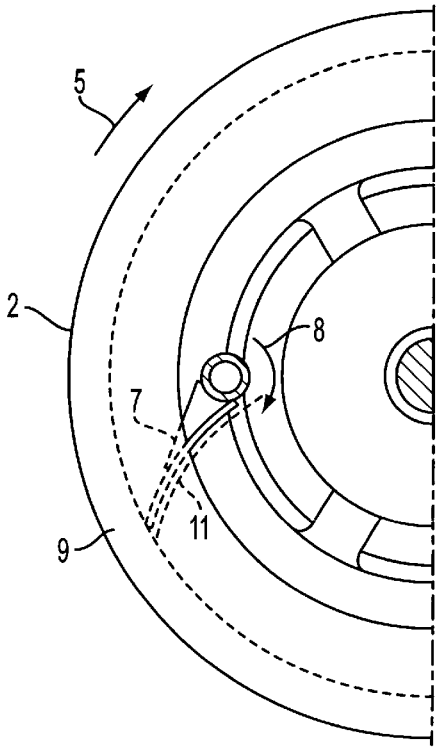
FIG. 4 is a plane view of the illustration in accordance with FIG. 3.

FIG. 3 shows the clearing-out device in its lowered position, in which the scraper blade 7, which extends over the entire height "h" of the basket, has been lowered to the base 3 of the basket. Moreover, FIGS. 3 and 4 show the scraper blade 7 in its position pivoted toward the wall, in which, at the start of the clearing-out operation, it bears against a layer of product 9, e.g., sugar.

Figure 5:
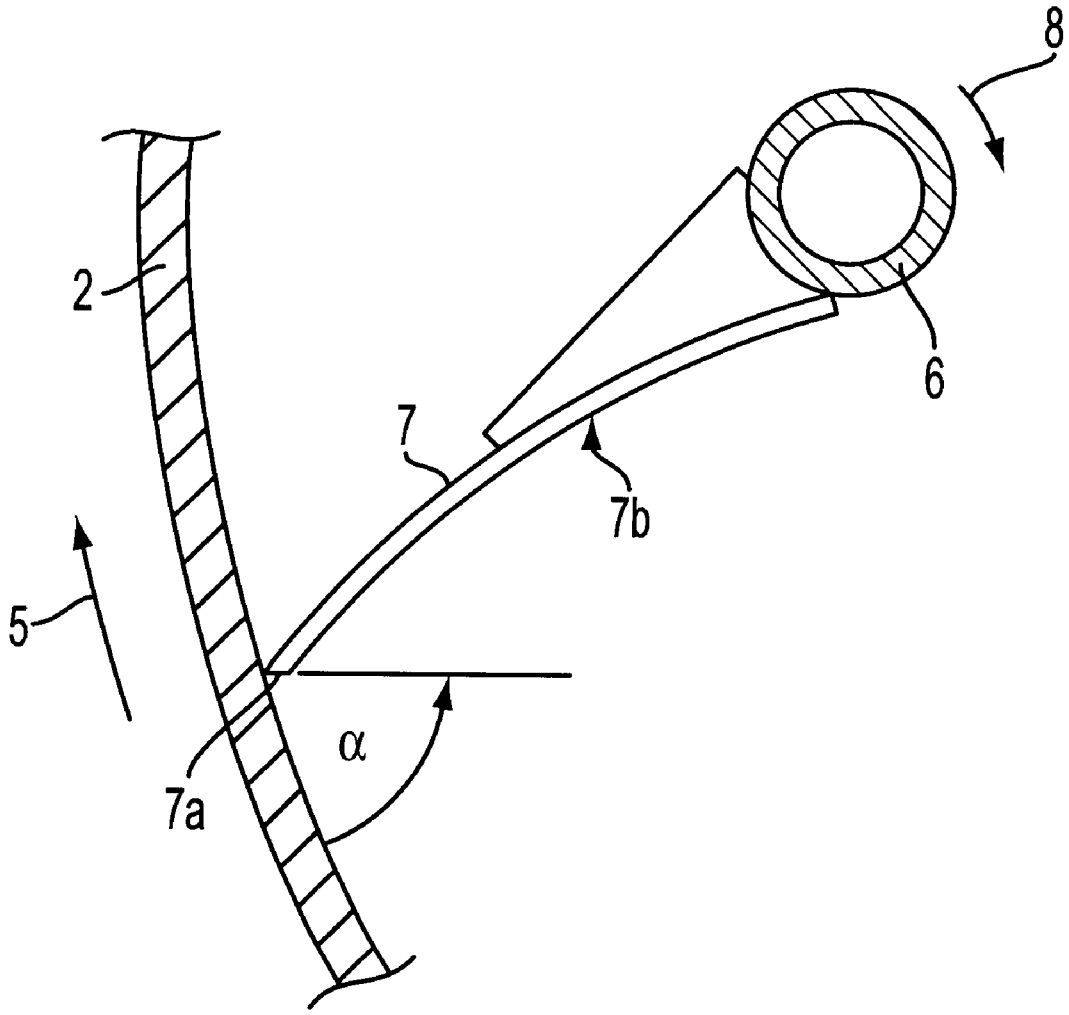
FIG. 5 is a horizontal section, on an enlarged scale compared to that of FIGS. 1 to 4, through the scraper blade in the position in which it is pivoted toward the wall.

FIG. 5 shows the scraper blade 7 in its position after the scraping operation has been completed, pivoted away from the basket wall. The cutting edge 7*a* of the scraper blade 7 is situated directly in front of the working sieve (not shown in more detail) of the basket shell 2. The cutting edge does not contact the working sieve. The cutting edge 7*a* when it is in its position pivoted toward the wall forms an angle $\alpha$ with respect to the basket sieve or the basket shell 2, which angle $\alpha$ is preferably between 80° and slightly less than 90°. As also shown in FIG. 5, the scraper blade 7, when seen in horizontal section, is slightly concave on its front side 7*b*.

In one application using a centrifuge, the magma, which is added to the centrifuge basket 1, is spun off in the centrifuge basket 1, which is driven at a high rotational speed. The mother liquor, which adheres to the crystals passing through the working sieve, runs through the holes of the basket shell 2 into the centrifuge casing (not shown in more detail). Then the crystals are washed with a clean liquid. The crystals remaining after the separation process in the basket form a layer of sugar 9, i.e., the product, which is scraped off the working sieve by the clearing-out device. After the closure cap has been opened, the sugar crystals which have been scraped off, are fed downstream on conveyor units.

FIG. 1 shows the clearing-out device in the raised position in which the bottom end of the scraper blade 7, in its position pivoted away from the wall, is at an axial distance "a" from the basket base 3, which distance "a" is preferably approximately 200 mm. The scraper blade 7 is lowered axially from this at-rest position, in the direction of the arrow 10, until the bottom end of the scraper blade 7 lies directly above the basket base 3, as shown in FIG. 3. As noted above, to increase the efficiency of the product removal process, the scraper blade preferably is lowered while the centrifuge is decelerating from its spinning speed to its clearing speed. After the lowered position and the clearing speed have been reached, the scraper blade 7 is then pivoted toward the wall in the direction of the arrow 8.

Figure 2:
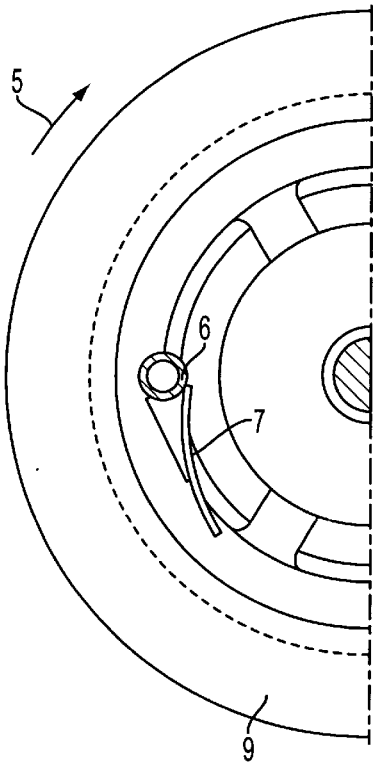
FIG. 2 is a plane view of the illustration in accordance with FIG. 1.

FIG. 4 shows that the scraper blade 8 is pivoted toward the wall in the direction of rotation 5 of the centrifuge basket 1. The sugar crystals are then scraped off simultaneously over the entire height "h" of the basket with the scraper blade 7 being continuously fed radially toward the wall. The dashed line 11 shown in front of the scraper blade 7 indicates the product flow of the crystals which are being scraped from the layer of sugar 9 by the scraper blade 7. When the scraper blade 7 has reached its limit position as shown in FIG. 5, the scraper blade then rests in this limit position for a few seconds before being pivoted away from the wall to its starting position, which is illustrated in FIGS. 1 and 2. By pivoting the scraper blade 7 away in a direction that is opposite to the direction of rotation 5 of the centrifuge basket 1, the residual sugar or product on the bottom edge of the scraper blade 7 is moved to the central discharge opening in the base 3 of the basket. Then, the clearing rod 6, together with the scraper blade 7, is raised again axially by the distance "a," into the at-rest position shown in FIG. 1.

After reading and understanding the foregoing description it will be appreciated that there are several distinct advantages in connection with the subject invention. Additional advantages and modifications will readily occur to those skilled in the art. The invention in its broadest aspects therefore is not limited to the specific details and preferred embodiments shown and described herein. Accordingly, various modifications may be made without departing from the spirit or scope of the general inventive concept as defined by the appended claims.

German Patent Application 198 19 065.4, filed Apr. 29, 1998, is hereby incorporated by reference in its entirety.

What is claimed is:

1. A method for clearing product from a centrifuge basket of a discontinuously running centrifuge, said basket comprising a peripheral wall and a bottom wall, said bottom wall closing one end of the peripheral wall, said peripheral wall defining a basket sieve and the entire axial length of the centrifuge length of the centrifuge basket, wherein a scraper blade, having a cutting edge, is projecting into the centrifuge basket, said method comprising:

lowering the scraper blade from an initial position, in axial direction of the centrifuge basket, until a starting position is reached where the scraper blade nearly touches the bottom wall of the centrifuge basket;

pivoting said scraper blade from said starting position towards the peripheral wall, wherein the cutting edge of said scraper blade lies in a direction opposite to a rotation direction of the basket, and wherein the scraper blade contacts the product over approximately the entire length of the centrifuge basket;

scraping the product off in layers as the centrifuge basket rotates at a clearing speed;

ceasing the pivoting of the scraper blade when its cutting edge reaches an advance limit position prior to touching the peripheral wall of the centrifuge basket;

pivoting the scraper blade away from the peripheral wall back into its starting position; and raising the scraper blade in axial direction back into its initial position.

2. A method for clearing product from a centrifuge basket as claimed in claim 1, wherein the scraper blade is lowered from its initial position while the centrifuge basket is decelerating from a spin-off speed to the clearing speed.

3. A method for clearing product from a centrifuge basket as claimed in claim 1, further comprising holding the scraper blade in said advance limit position for a period of time prior to being pivoted away from the peripheral wall.

4. A method for clearing the product from a centrifuge basket as claimed in claim 1, wherein said first pivoting has a pivoting direction that is the same as the rotation direction of the centrifuge basket.

5. A method for clearing the product from a centrifuge basket as claimed in claim 1, wherein said pivoting away has a pivoting direction that is opposite from the rotation direction of the centrifuge basket.

6. A method for clearing product from a centrifuge basket as claimed in claim 1, wherein lowering, pivoting and raising of the scraper blade are pneumatically controlled.

7. A method for clearing product from a centrifuge basket as claimed in claim 1, wherein the initial position is approximately 200 mm from the bottom wall of the centrifuge basket.

8. A clearing device for removing product from a centrifuge basket of a discontinuously running centrifuge, said basket comprising a peripheral wall and a bottom wall, said bottom wall closing one end of the peripheral wall, said peripheral wall defining a basket sieve and the entire axial length of the centrifuge basket, the clearing device comprising:

a clearing rod having an axis at least generally parallel to a rotational axis of the centrifuge basket and being displaceable in its axial direction;

a scraper blade, having a cutting edge, pivotably mounted on the clearing rod for pivoting about the axis of the clearing rod, wherein the cutting edge, after the scraper blade is pivoted in a direction toward the peripheral wall of the centrifuge basket, extends over approximately the entire axial length of the centrifuge basket and lies in a direction opposite to a rotation direction of the basket;

a lowering, pivoting and raising device for lowering the cleaning rod from an initial position of the scraper blade in axial direction of the centrifuge basket to a starting position, wherein the scraper blade nearly touches the bottom wall of the centrifuge basket at said starting position, and further for pivoting the scraper blade from said starting position towards the peripheral wall, for pivoting the scraper blade back into its starting position and for axially raising the scraper blade back into its initial position.

9. A clearing device as claimed in claim 8, wherein the scraper blade has a concave face.

10. A clearing device as claimed in claim 8, wherein the scraper forms an angle with the peripheral wall of the centrifuge basket, which angle is between 30° and less than 90°.

11. A cleaning device as claimed in claim 8, wherein the scraper blade has a nonstick coating.

12. A clearing device as claimed in claim 8, wherein the clearing rod is tubular and includes a nozzle for adding water to the centrifuge basket.

13. A discontinuously running centrifuge comprising:

a centrifuge basket having a peripheral wall, a bottom wall closing one end of the peripheral wall and a central product discharge opening in the bottom wall, said peripheral wall defining a basket sieve and the entire axial length of the centrifuge basket;

a closure cap for covering the central product discharge opening while the centrifuge is being operated; and a clearing device for removing a product from the centrifuge basket including:

a clearing rod having an axis at least generally parallel to a rotational axis of the centrifuge basket and being displaceable in its axial direction;

a scraper blade, having a cutting edge, pivotably mounted on the clearing rod for pivoting about the axis of the clearing rod, wherein the cutting edge, after the scraper blade is pivoted in a direction toward the peripheral wall of the centrifuge basket, extends over approximately the entire axial length of the centrifuge basket and lies in a direction opposite to a rotation direction of the basket;

a lowering, pivoting and raising device for lowering the clearing rod from an initial position of the scraper blade in axial direction of the centrifuge basket until a starting position, where the scraper blade nearly touches the bottom wall of the centrifuge basket, and further for pivoting the scraper blade from said starting position towards the peripheral wall, for pivoting the scraper blade back into its starting position and for axially raising the scraper blade back into its initial position.

* * * * *